United States Patent [19]

Hively

[11] 4,426,042

[45] Jan. 17, 1984

[54] METHOD OF SHREDDING SOLID WASTE

[75] Inventor: Eugene E. Hively, Emigsville, Pa.

[73] Assignee: Mineral Processing Systems, Inc., York, Pa.

[21] Appl. No.: 197,648

[22] Filed: Oct. 16, 1980

[51] Int. Cl.[3] ..... B02C 25/00

[52] U.S. Cl. ..... 241/21; 241/26; 241/30; 241/33

[58] Field of Search ..... 241/21, 26, 30, 62, 241/171, 176, 177, 178, 179, 184, DIG. 38, 33

[56] References Cited

U.S. PATENT DOCUMENTS 2,200,677 5/1940 Petersen ..... 241/DIG. 38
2,847,169 8/1958 Hartman ..... 241/184
3,010,661 11/1961 Weston ..... 241/30
4,210,290 7/1980 Andersson et al. ..... 241/30

*Primary Examiner*—Mark Rosenbaum
*Attorney, Agent, or Firm*—Thomas L. Sivak; Oscar M. Brumback; Charles J. Long

[57] ABSTRACT

An improved method of shredding municipal solid waste or garbage including the steps of introducing the solid waste into a tumbling mill having a diameter to length ratio of about 2.5:1 to 3:1, maintaining a negative pressure within the tumbling mill and maintaining a sufficient moisture content in solid waste. Shredding is accomplished by contacting the waste with irregular shaped grinding media within the tumbling mill.

1 Claim, 1 Drawing Figure

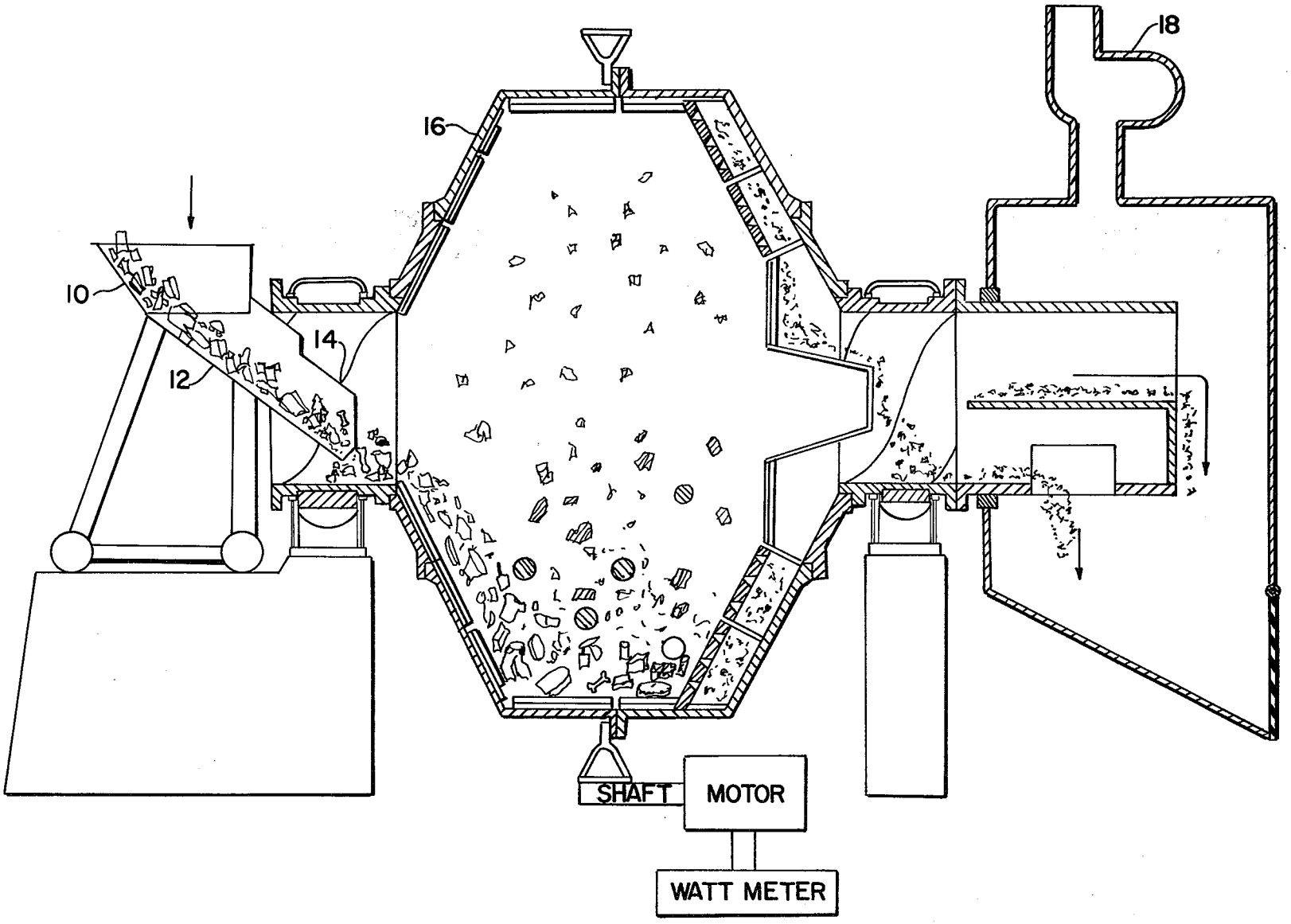
18
16
14
12
10
SHAFT
MOTOR
WATT METER

METHOD OF SHREDDING SOLID WASTE

BACKGROUND OF THE INVENTION

1. Field of the Invention

This invention relates to the grinding of solid material and, more particularly, to the grinding of municipal solid waste for either disposal or further processing.

2. Description of the Prior Art

Various apparatus and methods are employed today to shred municipal waste for disposal or further processing. In some of these systems conventional ball or rod mills having lengths greater than their diameters are used. However, in the systems, it has been found that it is very difficult to move the shredded waste horizontally through the mill because of the low bulk weight. This often results in mill overload which requires shutdown and cleaning of the material from the mill. The difficulty also has resulted in an energy loss because shredded material in traveling the required horizontal distances is continually ground finer.

In some operations to shred municipal waste, hammermill type shredders are employed. However, if a hammermill is used, the impact velocities must be low to minimize the detonation hazard associated with some items often found in municipal waste. In many cases the impact velocities are so low the mill is not an effective shredder. Also, the maintenance costs associated with hammermill shredders are relatively high when compared to tumbling mill shredders.

Accordingly, the objects of the present invention include a method for grinding municipal waste wherein the material is shredded in an economic, safe and efficient manner.

SUMMARY OF THE INVENTION

These and other objects of the present invention are accomplished by introducing the material to be shredded into a tumbling mill having a greater diameter than length, maintaining a negative pressure within the tumbling mill to control dust and odor and to facilitate the flow of the material through the mill and grates while controlling the moisture content of the material. Shredding of the material is accomplished by contacting the material within the mill with irregular shaped grinding media. The irregular shaped grinding media produces a line-type contact with the material resulting in more efficient shredding of the material. The shredded material is discharged from the tumbling mill through grates at the end of the mill opposite the entry port of the material.

BRIEF DESCRIPTION OF THE DRAWING

The FIGURE shows a schematic diagram of the method of the present invention.

DESCRIPTION OF THE PREFERRED EMBODIMENT

Referring to the FIGURE, the material to be shredded is conveyed from a collection bin 10 by a conventional conveyor 12 to an inlet port 14 of a tumbling mill

16 which has a diameter to length ratio of about 2.5:1 to 3:1. Mills of this type have been in commercial use for many years, primarily for the autogenous grinding of mineral-bearing ores and the design and operation thereof are well-known and understood in the art. Therefore, the specifics of the construction of such tumbling mills will not be repeated herein unless it is necessary for one skilled in the art to understand the method of the present invention. Water is added to the material in the collection bin 10. The moisture content of the material is controlled at approximately 25–35 percent by weight. The moisture content can be controlled by weighing the material in any conventional manner prior to placing it in bin 10 and injecting the proper amount of water from a tank, not shown, having a flow regulator. The moisture of the material is controlled since much of the material found in municipal waste, cardboard, and paper requires considerable more energy for shredding when dry then when wet. The mill motor power draw is monitored in a conventional manner by means of a watt meter to determine if excessive power is being used in the grinding operation. If so, the moisture content of the material being injected into the mill can be increased until a satisfactory power draw level is attained commensurate for the size of the mill.

A negative pressure is maintained in the interior of mill 16 by a commercially available vent fan 18 fixed to mill 16 in a conventional manner. The negative pressure which is in the range of 0.5 to 1.0 inches of water aids in the flow of material through the mill and helps maintain dust and odor control. The grinding media used in the method of the present invention is irregular in shape as contrasted to the spherical shape of media used in conventional tumbling mills. Preferably the media weighs about ten pounds and is shaped to have one long dimension in relation to the other dimensions to provide a line-type contact between the media and material for optimum shredding. After contact with the grinding media, the shredded material is discharged through the grates and conveyed from the mill through conventional means for disposal or further processing.

While I have described a certain preferred embodiment of my invention, it will be understood it may be otherwise practiced within the scope of the following claims.

What is claimed:

1. A method for shredding municipal solid waste including the steps of:

(a) contacting said waste with moisture in a collecting bin to maintain the moisture content of said waste between 25–35 percent by weight;

(b) introducing said waste from said bin into a tumbling mill, said tumbling mill having a diameter to length ratio of from 2.5:1 to 3:1;

(c) causing said waste to contact irregular shaped shredding media within said mill to shred said waste for further processing and (d) monitoring the power draw of said tumbling mill to control the moisture content of said waste.

* * * * *